United States Patent [19]

Raskin et al.

[11] 4,227,278

[45] Oct. 14, 1980

[54] FEATHER DUSTER

[75] Inventors: Sidney Raskin, Sioux City, Iowa; Nate Mantel, Jr., Omaha, Nebr.

[73] Assignee: H. K. Specialty Co., Inc., Omaha, Nebr.

[21] Appl. No.: 971,246

[22] Filed: Dec. 20, 1978

[51] Int. Cl.[3] ..... A47L 13/38

[52] U.S. Cl. ..... 15/234; 15/184

[58] Field of Search ..... 15/184, 186, 234; 428/6

[56] References Cited

U.S. PATENT DOCUMENTS

| | | | |
|---|---|---|---|
| 77,278 | 4/1868 | Goodenough | 15/234 |
| 227,837 | 5/1880 | Richmond | 15/234 |
| 1,033,898 | 7/1912 | Isham | 15/234 |
| 2,958,087 | 11/1960 | Obeck | 15/184 |
| 2,984,852 | 5/1961 | George | 15/234 X |
| 3,095,593 | 7/1963 | Krasne | 15/234 |
| 3,162,880 | 12/1964 | Francis | 15/15 A X |
| 3,189,508 | 6/1965 | Burnbaum | 24/208 A X |
| 3,302,917 | 2/1967 | Winkler | 248/359 X |

FOREIGN PATENT DOCUMENTS

| | | | |
|---|---|---|---|
| 337564 | 6/1921 | Fed. Rep. of Germany | 428/6 |
| 1106393 | 7/1955 | France | 15/184 |
| 303820 | 12/1932 | Italy | 15/234 |

*Primary Examiner*—Edward L. Roberts

*Attorney, Agent, or Firm*—Robert W. Carlson

[57] ABSTRACT

A feather duster being adapted to be retracted into a protective casing and having the feathers arranged in such a manner so as to create a static electrical charge on the feathers which results in a more efficient gathering of dust.

1 Claim, 4 Drawing Figures

Fig. 1
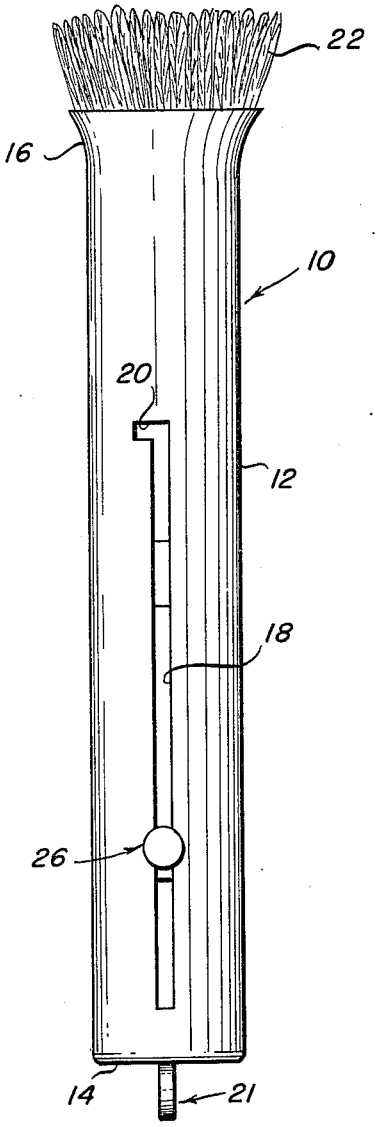
Fig. 2
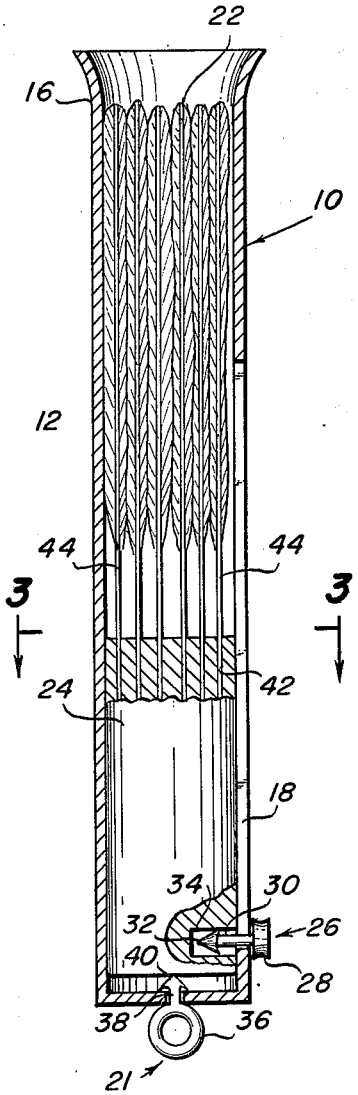
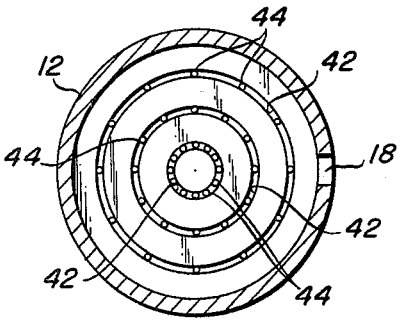
Fig. 3
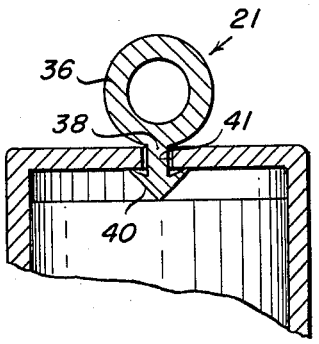
Fig. 4

FEATHER DUSTER

BACKGROUND OF THE INVENTION

An effective implement for dusting both in commercial establishments and households is the feather duster. The most durable and effective feather for use in such devices is the ostrich feather. The ostrich feather is superior to other feathers in this use in that it has a flexible shaft with many long very flexible barbs growing from the shaft. Because of this, a feather duster made of ostrich feathers will not scratch nor damage the most fragile item. The flexibility and softness of the barbs enables it to collect dust very readily. Ostrich feathers must be imported into this country at considerable expense. It is therefore desirable to provide a protective casing in which the feathers may be stored when the duster is not in use. The patent to Krasne U.S. Pat. No. 3,095,593 discloses such a feather duster. The present invention is an improvement on such a feather duster.

THE INVENTION

The invention provides an improvement over the prior art devices in that the individual feathers are arranged in a manner so as to create static electricity which attracts the dust to the feathers. The feather duster of this invention includes a tubular handle into which the feathers may be retracted and the handle is provided with a hook so the feather duster may be conveniently hung up when not in use. The invention further provides a novel method of securing the hook to the handle as well as securing the actuating button to the retracting means.

It is therefore an object of this invention to provide a feather duster which creates a static electrical charge to enhance its dust collecting properties.

It is a further object of this invention to provide a feather duster which may be retracted into a tubular handle and having a hook whereby the feather duster may be easily hung for storage.

It is still a further object of this invention to provide a method of affixing a hook to the handle of a feather duster.

It is still a further object of this invention to provide a feather duster having a tubular handle into which the feathers may be retracted and a simple method in which the actuating button is affixed to the retracting means.

These and other objects not specifically eluded to herein, but inherent in the inventive concept disclosed will become readily apparent to those skilled in the art from consideration of the following description of the invention and they are within the spirit and scope of the following detailed specifics of the invention.

FIG. 1 is a front elevation of the duster and casing of the invention with the feathers partially extended;

FIG. 2 is a side elevation in section of the duster in fully retracted position;

FIG. 3 is a sectional view taken on line 3—3 of FIG. 2; and

FIG. 4 is a partial sectional view of the feather duster handle and hook.

Referring now to the drawings in detail, the feather duster 10 comprises a tubular handle 12 having a closed end 14 and an open end 16 which is flared outwardly from the tubular handle 12. The handle is provided with an elongated slot 18 extending longitudinally of the handle 12 and terminating in a laterally extending portion 20. A hook 21 is provided on the closed end 14 of the handle 12.

A plurality of feathers 22 are mounted on a cylindrical plug 24. The plug 24 may be formed of any suitable material such as plastic or wood and is of such a diameter that it may readily slide within the tubular handle 21. The plug 24 is provided with an actuating button 26.

The feathers 22 are extended from and retracted into the handle 21 by the user manipulating the actuating button 26 in the desired direction. The actuating button 26 comprises a thumb piece 28 mounted on a pin 30 having a barbed member 32 on its end. The barbed member 32 is flexible so that it may be frictionally held within the bore 34 in the plug 24.

The hook 21 comprises a ring 36 having a stem 38 which terminates in a barbed portion 40. The hook 21 is affixed to the end 14 of the handle 12 by inserting the barbed portion and stem through an opening 41 in the end 14. The barbed portion is formed of flexible material so that the outer lip folds back against the stem 38 as it passes through the opening 41. Once through, the outer lip extends outwardly as shown in FIG. 4 and maintains the hook 21 on the handle 12.

The individual feathers are mounted on the plug 24 in a predetermined spaced relationship. It is because of the spacing of feathers that the static electricity is formed. This phenomenon is not completely understood but such static electricity does not occur in such prior art devices such as that of Krasne U.S. Pat. No. 3,095,593.

The one end of the plug 24 is provided with a plurality of concentric annular grooves 42 as best shown in FIG. 3. The annular grooves are radially spaced equal distances from each other. Each feather 22 is mounted on the plug 24 by inserting the shaft 44 into an annular groove 42 and securing it therein with suitable adhesive. The shafts 44 are equally spaced from each other about the grooves 42.

Instead of providing annular grooves in the plug 24, a plurality of individual bores of a size to receive each shaft may be formed in the plug 24. The bores would be formed in concentric rings the same as the annular grooves.

In view of the foregoing, it is readily apparent that the present invention provides a novel and improved feather duster construction in which the parts can be economically manufactured and readily assembled.

When the duster is to be used, one merely grasps the thumb piece 28 of the actuating button 26 and moves the plug 24 toward the open end of the handle 12. When the feathers 22 are fully extended, the actuating button 26 is moved laterally into the slot portion 20 to lock the feathers 22 in their extended position.

The various parts of the feather duster may be readily assembled. Once the feathers 22 are secured in the plug 24, the plug 24 may be inserted into the tubular handle 12 with the bore 34 aligned with the slot 18. The actuating botton 26 is then inserted through the slot 18 into the bore 34 and is frictionally held therein by the barb member 32. The hook 21 is inserted through the opening 41 in the manner explained above.

Having described the product in detail, it will be apparent that changes and modifications will occur to those skilled in the art and all of which may fall within the spirit and scope of the appended claims wherein;

What is claimed is:

1. A feather duster comprising a tubular handle having a closed end and a flared open end, a cylindrical plug slidably mounted in said tubular handle, a plurality of feathers having their shafts secured in said plug in the formation of a plurality of rings, said shafts of the feathers being equally spaced from each other around the rings, said rings being spaced radially equal distances apart, an elongated slot in said handle, said elongated slot having a laterally extending portion adjacent the open end of said handle, a laterally extending bore in said plug, an actuating button comprising a thumb piece mounted on a pin having a barbed member on its end, said actuating button being frictionally held within said bore and projecting outwardly through said elongated slot in said handle for extending and retracting said feathers, said actuating button adapted to be positioned in said laterally extending portion of said elongated slot to lock said feathers in extended position, a ring having a barbed portion extending through a hole in the closed end of said handle for hanging the feather duster when not in use.

* * * * *